US008073174B2

(12) United States Patent
Mueller et al.

(10) Patent No.: US 8,073,174 B2
(45) Date of Patent: Dec. 6, 2011

(54) FIXATION ELEMENT FOR AN IMPLANTABLE MICROPHONE

(75) Inventors: Gerd M. Mueller, Lohhof (DE); Hans Leysieffer, Taufkirchen (DE)

(73) Assignee: Phonak AG, Staefa (CH)

( * ) Notice: Subject to any disclaimer, the term of this patent is extended or adjusted under 35 U.S.C. 154(b) by 1562 days.

(21) Appl. No.: 11/419,083

(22) Filed: May 18, 2006

(65) Prior Publication Data

US 2006/0233410 A1 Oct. 19, 2006

Related U.S. Application Data

(62) Division of application No. 10/010,155, filed on Dec. 10, 2001, now Pat. No. 7,058,192.

(30) Foreign Application Priority Data

Dec. 14, 2000 (DE) ..... 100 62 236

(51) Int. Cl.
*H04R 25/00* (2006.01)

(52) U.S. Cl. ..... 381/326; 381/328; 381/355

(58) Field of Classification Search ..... 381/326, 381/328; 181/130, 135; 600/25
See application file for complete search history.

(56) References Cited

U.S. PATENT DOCUMENTS

| | | | | |
|---|---|---|---|---|
| 4,972,488 | A | 11/1990 | Weiss et al. | |
| 5,951,601 | A | 9/1999 | Lesinski et al. | |
| 5,999,632 | A * | 12/1999 | Leysieffer et al. | 381/328 |
| 6,786,860 | B2 | 9/2004 | Maltan et al. | |
| 6,795,562 | B1 | 9/2004 | Gunnersen et al. | |
| 6,876,860 | B1 * | 4/2005 | Berg et al. | 455/459 |
| 7,058,192 | B2 * | 6/2006 | Muller et al. | 381/326 |
| 7,127,078 | B2 * | 10/2006 | Mann et al. | 381/326 |
| 7,224,815 | B2 * | 5/2007 | Maltan et al. | 381/322 |

* cited by examiner

*Primary Examiner* — Davetta W Goins
*Assistant Examiner* — Phylesha Dabney
(74) *Attorney, Agent, or Firm* — Roberts Mlotkowski; Safran & Cole, P.C.; David S. Safran

(57) ABSTRACT

A fixation element for an implantable microphone is disclosed. In a preferred embodiment the fixation element comprises an essentially cylindrical portion adapted to be inserted into a bore which crosses a wall of the auditory canal of a user, said cylindrical portion, at least in an implanted state of the fixation element, surrounding an outer circumferential portion of a housing part of the microphone, which housing part is provided with a sound receiving member. The cylindrical portion includes at least one elastic region of increased diameter, said elastic region contacting, in the implanted state of the fixation element, a wall of said bore and providing, by elastic restoring forces, for a friction which is sufficiently high to fix said cylindrical portion in at least one of the two axial directions of said bore.

13 Claims, 15 Drawing Sheets

FIXATION ELEMENT FOR AN IMPLANTABLE MICROPHONE

CROSS REFERENCE TO RELATED APPLICATION

This application is a divisional of commonly owned, U.S. patent application Ser. No. 10/010,155, filed Dec. 10, 2001, now U.S. Pat. No. 7,058,192.

BACKGROUND OF THE INVENTION

1. Field of the Invention

The invention relates to a fixation element for an implantable microphone, which element is adapted to be inserted into a bore which crosses a wall of the auditory canal of a user.

2. Description of Related Art

Such a fixation element is known e.g. from U.S. Pat. No. 5,999,632. The known fixation element comprises a cylindrical portion which surrounds an outer circumferential portion of a housing part of the microphone. This housing part is provided with a sound receiving member of the microphone, particularly an acoustic membrane, which is left uncovered by the fixation element. Projecting elastic flange portions are provided at the side of the cylindrical portion which, in the implanted state of the fixation element, faces the skin of the auditory canal. In the implanted state of the fixation element, these flange portions contact the respective side of the wall of the auditory canal. A further flange portion is provided at the side of the cylindrical portion which, in the implanted state of the fixation element, is remote from the skin of the auditory canal, and this further flange portion is adapted to contact the other side of the wall of the auditory canal. The flange portions and the cylindrical portion define a sleeve by which the microphone is fixed in the wall of the auditory canal. The cylindrical portion has a smooth outer side for contacting the wall of the bore.

International Patent Application Publication WO-A 97/36457 discloses a fixation element for fixing a microactuator of an implantable hearing systems in a bore in the promontorium wherein sleeve portion is inserted into the bore, and wherein this sleeve portion is provided at one end thereof with a circumferentially extending projecting flange which contacts one side of the promontorium. The part of the sleeve portion disposed within the bore is hollow-cylindrical and has a smooth outer surface. At the end opposite the flanged end, the hollow-cylindrical portion is provided with zone within which the inner and outer diameters of the hollow-cylindrical portion conically increase. The cylindrical microactuator is inserted into the sleeve portion from the flanged side thereof and is locked by lock means provided on the flange.

SUMMARY OF THE INVENTION

A primary object of the present invention is to devise a functionally improved fixation element for an implantable microphone.

This object is achieved in conformity with one aspect of the invention by a fixation element for an implantable microphone, wherein the fixation element comprises an essentially cylindrical portion adapted to be inserted into a bore which crosses a wall of the auditory canal of a user, said cylindrical portion, at least in an implanted state of the fixation element, surrounding an outer circumferential portion of a housing part of the microphone, which housing part is provided with a sound receiving member, wherein said cylindrical portion includes at least one elastic region of increased diameter, said elastic region contacting, in the implanted state of the fixation element, a wall of said bore and providing, by elastic restoring forces, for a friction which is sufficiently high to fix said cylindrical portion in at least one of the two axial directions of said bore.

This solution is advantageous in that the fixation element may be fixed at least in axial direction of the bore in the wall of the external auditory canal of a user by simple structural means and that optionally also proper sealing of the bore in the auditory canal wall may be obtained, without a flange portion projecting into the auditory canal being required. The fixation element can be inserted into the bore in a particularly simple manner.

In conformity with a further aspect of the invention a fixation element for an implantable microphone comprises an essentially cylindrical portion adapted to be inserted into a bore which crosses a wall of the auditory canal of a user, wherein the cylindrical portion surrounds an outer circumferential portion of a housing part of the microphone, which housing part is provided with a sound receiving member, wherein the ends of the cylindrical portion each are provided with a flange member which flange members, in the implanted state of the fixation element, each contact one side of the wall of the auditory canal, and wherein the cylindrical portion is provided at the outer circumference thereof with axially extending protruding web elements of elastic material which, upon insertion of the cylindrical portion into the bore, contact the wall of the bore under the influence of elastic restoring forces.

The latter solution is advantageous in that the protruding web elements due to their elasticity provide for a good fit of the fixation element within the bore. Diameter variations of the bore can be compensated at least within a certain range. Furthermore, a proper sealing and a uniform distribution of pressure forces within the bore may be obtained.

In conformity with a further aspect of the invention a fixation element for an implantable microphone comprises first and second members, wherein the first member has a stud adapted for insertion into a bore which crosses a wall of the auditory canal of a user, wherein the stud has a first free end and an opposite second end and encloses a housing part of the microphone at the outer circumference thereof, which housing part is provided with a sound receiving member, wherein the second member comprises a first flange portion and a sleeve portion, the sleeve portion having opposite first and second ends and being adapted to be slipped, starting with the first end thereof, over said first end of the stud and to be engaged with the stud for preventing at least relative axial movement between the stud and the sleeve portion, and wherein the first flange portion is provided at the second end of the sleeve portion and is adapted to engage, in the implanted state of the fixation element, the side of the wall of the auditory canal facing the skin of the auditory canal.

The latter solution is advantageous in that it is not required that the flange which in the implanted state engages a side of the auditory canal wall, be moved through the bore. Rather, the member provided with this flange may be put in a cap-like manner on the member mounting the microphone to fix the microphone in the auditory canal wall.

In conformity with a still further aspect of the invention a fixation element for an implantable microphone comprises a cylindrical portion adapted to be inserted into a bore crossing a wall of the auditory canal of a user and surrounds an outer circumferential portion of a housing part of the microphone provided with a sound receiving member, wherein the cylindrical portion is provided at a first end thereof with a first flange portion which, in the implanted state of the fixation element, contacts a side of the wall of the auditory canal facing the skin of the auditory canal, wherein the cylindrical portion is provided with a second flange portion which, in the implanted state of the fixation element, contacts a side of the wall of the auditory canal remote from the skin of the auditory canal, wherein the first flange portion is comprised of a plurality of circumferentially spaced elastic first holding tongues, wherein first recesses are provided in the outer circumference of the cylindrical portion, and wherein said first holding tongues are adapted to be folded towards and received by the first recesses to facilitate introduction of the cylindrical portion into the bore.

This solution is advantageous in that the first flange portion is adapted to be particularly easily moved through the bore.

In conformity with another aspect of the invention a fixation element for an implantable microphone comprises a stud adapted to be inserted into a bore which crosses a wall of the auditory canal of a user, wherein the cylindrical portion surrounds an outer circumferential portion of a housing part of the microphone, which housing part is provided with a sound receiving member, wherein the stud is provided at one end thereof with lamellas which are distributed in circumferential direction of the stud, wherein these lamellas have one end thereof pivotally fixed to the circumference of the stud, and wherein the lamellas, in the implanted state of the fixation element, contact a side of the wall of the auditory canal facing the skin of the auditory canal.

A particular advantage of this solution is that the fixation element can be positioned in the bore in a simple manner because introduction into the bore is facilitated by the lamellas being folded rearwardly in the direction of introduction.

DETAILED DESCRIPTION OF THE INVENTION

Figure 1A:
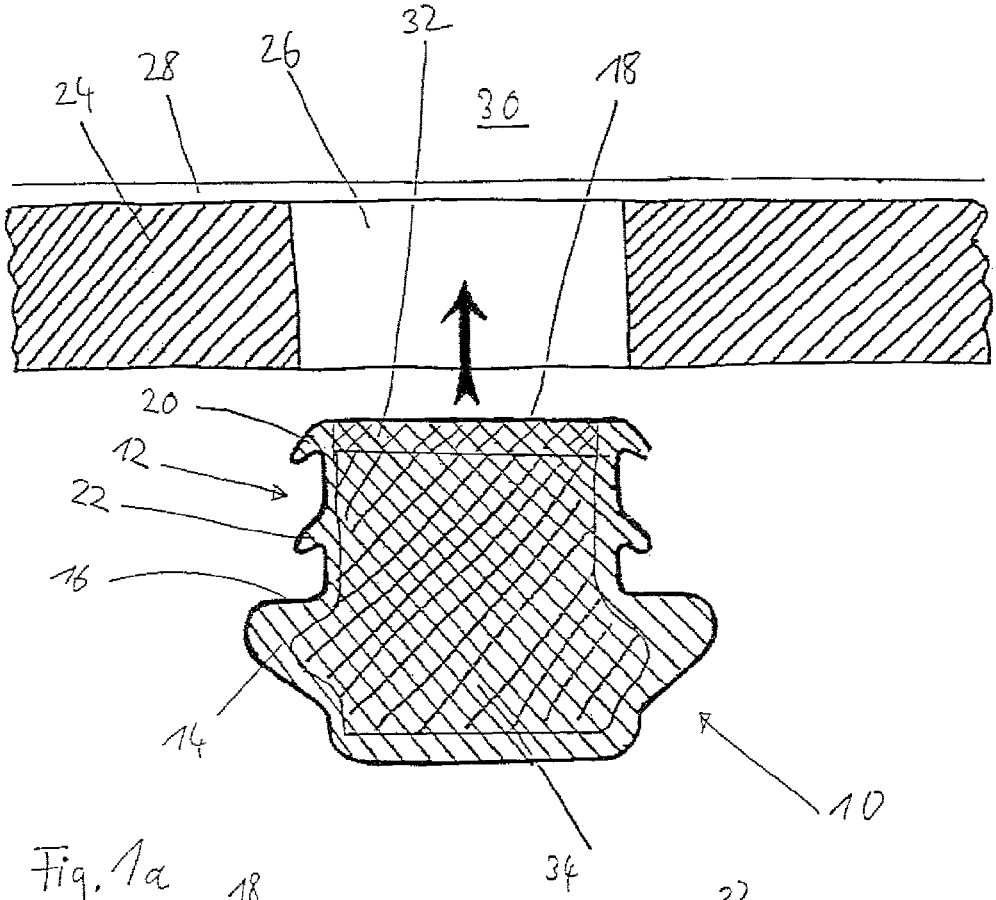
FIGS. 1*a* and 1*b* show sectional views of a first embodiment of a fixation element in conformity with the invention before and after, respectively, insertion into a bore of a wall of the external auditory canal of a user.
Figure 1B:
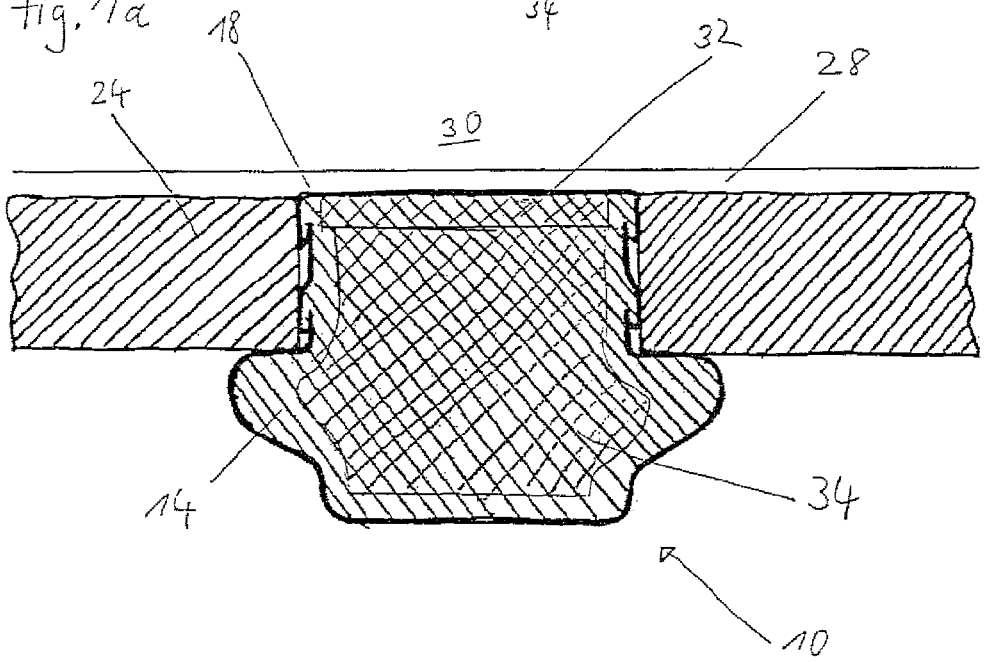
Figure 2:
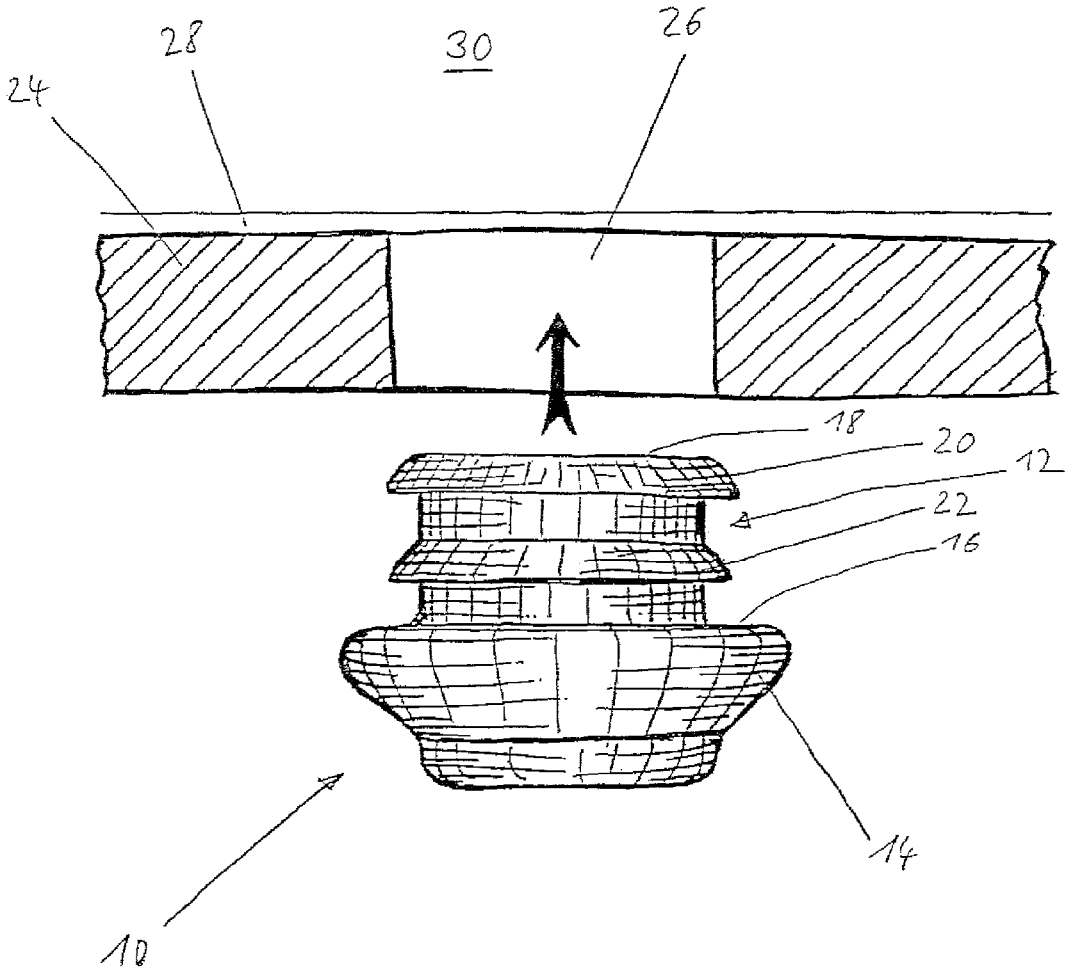
FIG. 2 shows a side view of the fixation element of FIG. 1*a*.

FIGS. 1*a* and 1*b* show a first embodiment of a fixation element 10 which essentially comprises a substantially circular cylindrical portion 12 and a flange portion 14 connected thereto. Flange portion 14 radially projects from the cylindrical portion 12, defines a contact surface 16 and surrounds a sound sensor. Cylindrical portion 12 and flange portion 14 preferably are structured as a shell of plastic material, wherein the cylindrical portion 12 extends around a housing part 34 of the sensor that is provided with a sound receiving member 32, such as a membrane. The sound receiving member is placed at a free end 18 of the cylindrical portion 12 and is left uncovered by the shell.

Cylindrical portion 12 includes a pair of axially spaced, circumferentially extending sealing lips 20 and 22 which are made of elastic material and which are tapered toward the free end 18. Sealing lip 20 is disposed close to the free end 18, whereas sealing lip 22 is arranged in a central part of the cylindrical portions 12. The sealing lips 20 and 22 as well as the remainder of the fixation element 10 are preferably made of silicone.

The sensor is connected to an electronic unit of an implantable hearing system via electrical connection means which are not illustrated.

Fixation element 10 is configured for implantation in a bore 26 which crosses a rear part of the bony wall 24 of an external auditory canal 30 of a user. Wall 24 is covered at its side facing the auditory canal 30 with skin 28.

During implantation of fixation element 10, the cylindrical portion 12 is introduced into bore 26 from the side of the auditory canal wall 24 which is remote from auditory canal skin 28. The outer circumference of the sealing lips 20 and 22 is larger than the inner circumference of bore 26. In view of the fact that sealing lips 20 and 22 are elastic and are tapered towards free end 18, sealing lips 20 and 22 are compressed in radial inward direction, whereby radially outwardly acting elastic restoring forces are generated. When the cylindrical portion 12 is completely introduced into bore 26 as shown in FIG. 1*b*, free end 18 together with membrane 32 is substantially flush with the side of the auditory canal wall 24 covered by auditory canal skin 28. The elastic restoring forces cause sealing lips 20 and 22 to sealingly contact the wall of bore 26, wherein the material and the dimensions of the sealing lips 20 and 22 are selected such that the restoring forces are sufficient to prevent movement of the fixation element 10 towards the side of auditory canal wall 24 remote from auditory canal skin 28. The sealing lips 20 and 22 furthermore are designed to be able to fold, during insertion of cylindrical portion 12 into bore 26, radial inwardly towards the side of auditory canal wall 24 remote from auditory canal skin 28. This structure of the sealing lips 20, 22, which is asymmetrical with respect to the direction of movement of the sealing lips 20, 22 relative to the auditory canal wall 24, offers the advantage that the force required for introduction of the cylindrical portion 12 into bore 26 is substantially lower than the force necessary to pull the cylindrical portion 12 out of bore 26. Thereby an unintended loosening of the fixation element 10 from bore 26 may be reliably prevented.

Sealing lip 22 is disposed in axial direction so as to contact, in the implanted state shown in FIG. 1*b*, the wall of bore 26 near the end of bore 26 remote from auditory canal skin 28. This provides for a highly uniform distribution of the forces acting between cylindrical portion 12 and the wall of bore 26.

In the position shown in FIG. 1*b* the contact surface 16 of flange portion 14 contacts the side of auditory canal wall 24 remote from auditory canal skin 28 whereby any further movement of the fixation element 10 towards the auditory canal 30 is made impossible. In this manner the interaction of sealing lips 20 and 22 and contact surface 16 provides for a fixation of the sound receiving sensor in both directions within the auditory canal wall 24. The elasticity of the sealing lips 20, 22 permits a compensation of diameter variations or diameter deviations, that is, the diameter of bore 26 may be within a certain tolerance range, within which the sealing lips 20, 22 provide for proper sealing of bore 26 as well as for proper fixation of the fixation element within bore 26.

Figure 3A:
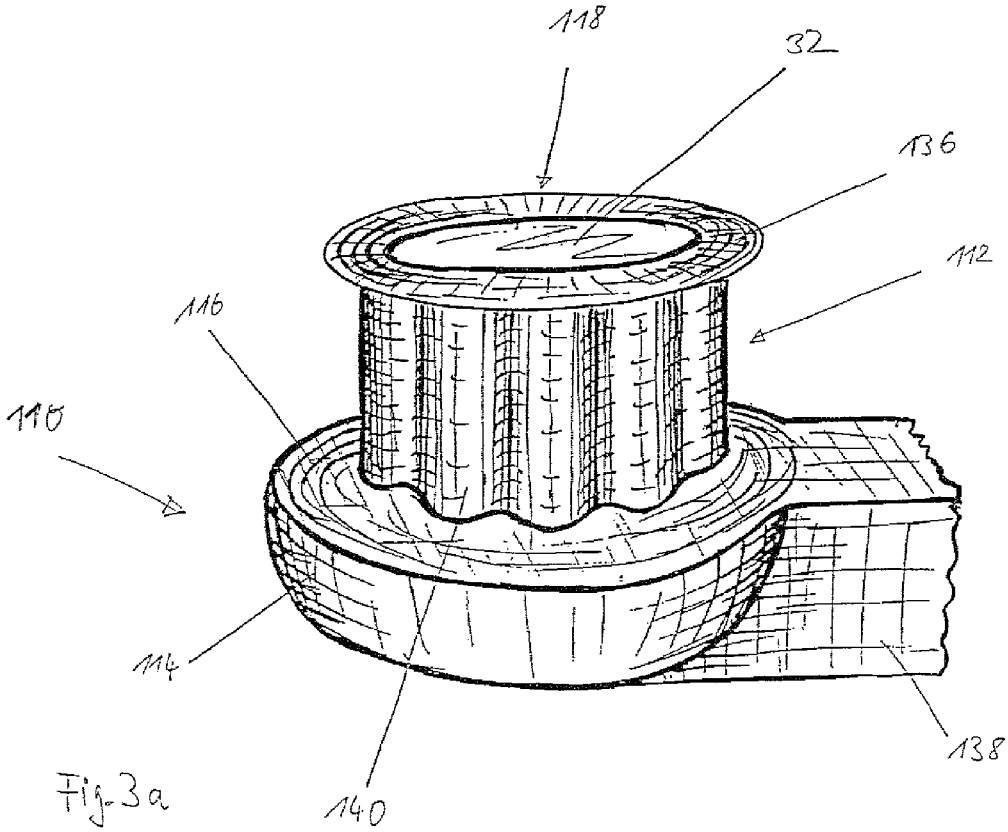
FIG. 3*a* is a perspective view of a second embodiment of a fixation element in conformity with the invention.
Figure 3B:
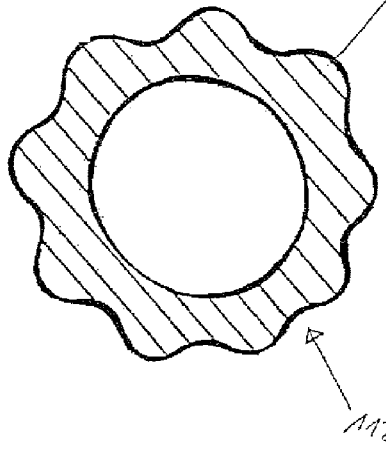
FIGS. 3*b* and 3*c* show sectional views of the fixation element of FIG. 3*a* before and after, respectively, insertion into a bore of a wall of the external auditory canal of a user.
Figure 3C:
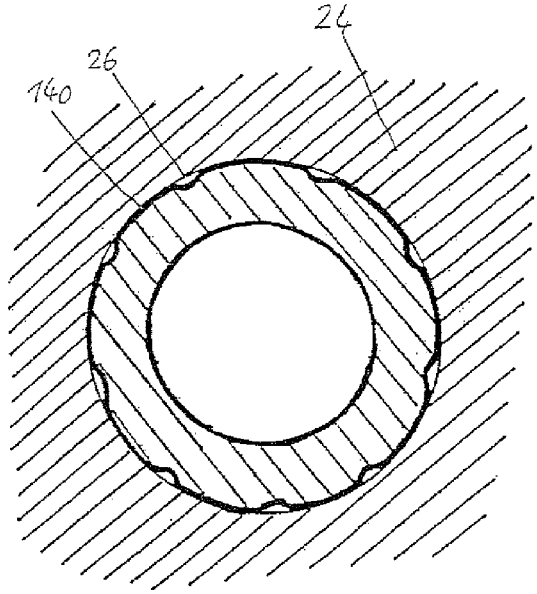

FIGS. 3*a* to 3*c* illustrate a fixation element 110 having a cylindrical portion 112 which is provided at a free end 118 thereof with a circumferentially extending, radially projecting elastic rim or flange portion 136. Sound receiving membrane 32 is disposed at free end 118. A flange portion 114 defining a contact surface 116 is provided at the other end of cylindrical portion 112. An elongated portion 138 radially extends from flange portion 114. Electrical connections for the sensor are embedded in elongated portion 138. Cylindrical portion 112 is provided at its outer circumference with axially extending elements 140 an of elastic material. As particularly shown in FIG. 3*b*, elements 140 are protruding in a rib-like manner and are configured to provide in circumferential direction for an undulated contour. The diameter of an envelop of protruding elements 140 is larger than the inner diameter of bore 26 in the auditory canal wall 24, when the fixation element 110 is not in yet inserted into bore 26. The elements 140 are uniformly spaced from each other in circumferential direction.

The outer diameter of flange 136 and the elasticity thereof are selected such that flange 136 is adapted to be passed through bore 26. In doing so, flange 136 at first is folded back into bore 26. The folded flange 136 defines a forwardly tapering portion which facilitates the introduction of portion 112 having the protruding elements 140. The latter are compressed in radial direction when entering bore 26. When flange 136 has left the end of bore 26 facing the external auditory canal, it again takes the shape shown in FIG. 3*a*, wherein the side of flange 136 facing flange portion 114 contacts the side of auditory canal wall 24 which faces the auditory canal wall, with flange 136 being disposed beneath the skin 28 of the auditory canal. In the inserted state illustrated in FIG. 3*c*, the protruding elements 140 are radially compressed whereby elastic restoring forces are generated, which provide for a certain fixation of the cylindrical portion 112 in axial direction of bore 26 as well as for centering of the fixation element 110 in bore 26. Particularly, diameter variations or deviations of bore 26 may be compensated within a certain tolerance range by the elasticity of the protruding elements 140.

As already mentioned, flange portions 114 and 136 engage opposite sides of auditory canal wall 24 and provide for additional fixing of element 110.

Figure 8:
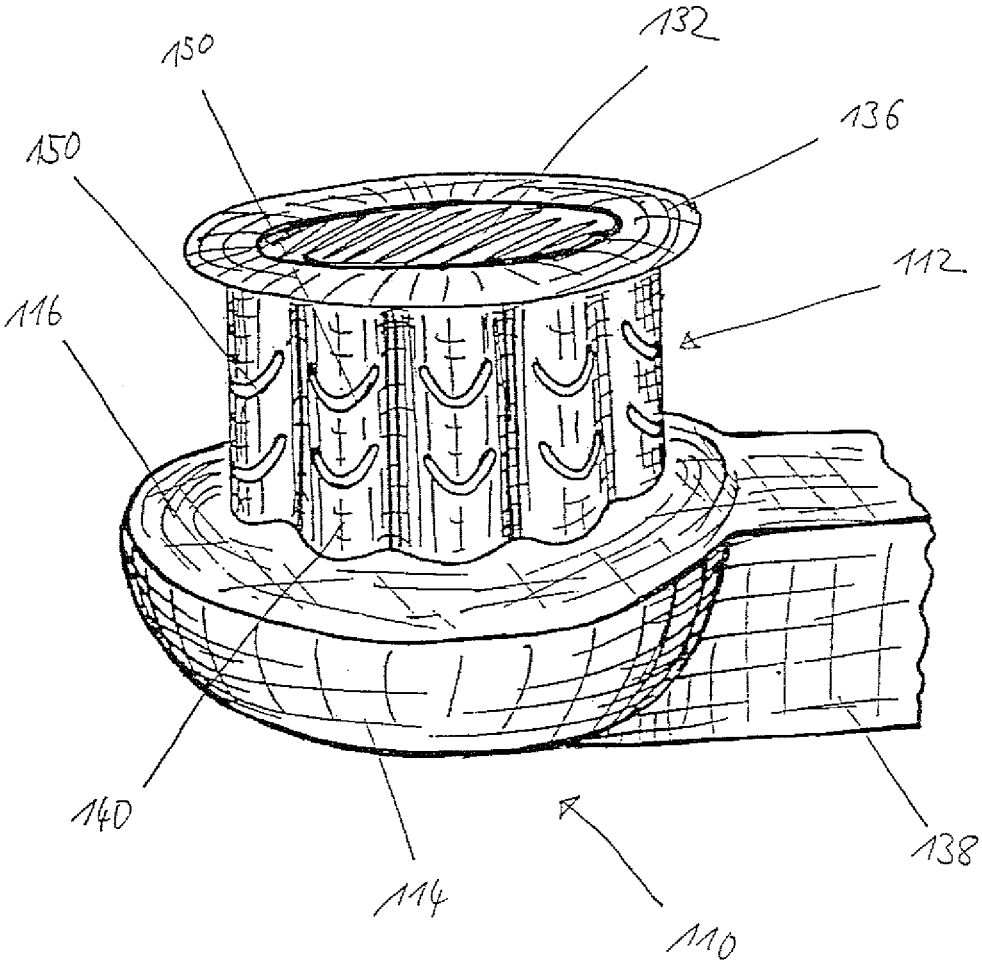
FIG. 8 is a view similar to FIG. 3*a* for an alternative embodiment of a fixation element in conformity with the invention.

FIG. 8 illustrates a modification of the embodiment of FIG. 3*a*, wherein the web-shaped protruding elements 140 are provided with slots 150 which, when seen in axial direction, are approximately V-shaped. Each element 140 includes a pair of such slots 150 which are spaced from each other in axial direction. The open side of slots 150 is directed toward the end of cylindrical portion 112 provided with flange 136. The function of slots 150 essentially is that—in view of the elasticity of elements 140—the side of slot 150 which is closer to flange 136 (i.e. in FIG. 8 the upper side of each slot 150), by contacting the wall of bore 26, acts as an abutment which prevents the cylindrical portion 112 from being pulled out of bore 26. Stated otherwise, the force required for introducing cylindrical portion 112 into bore 26 is substantially smaller than the force necessary for pulling portion 112 out of bore 26.

Figure 4A:
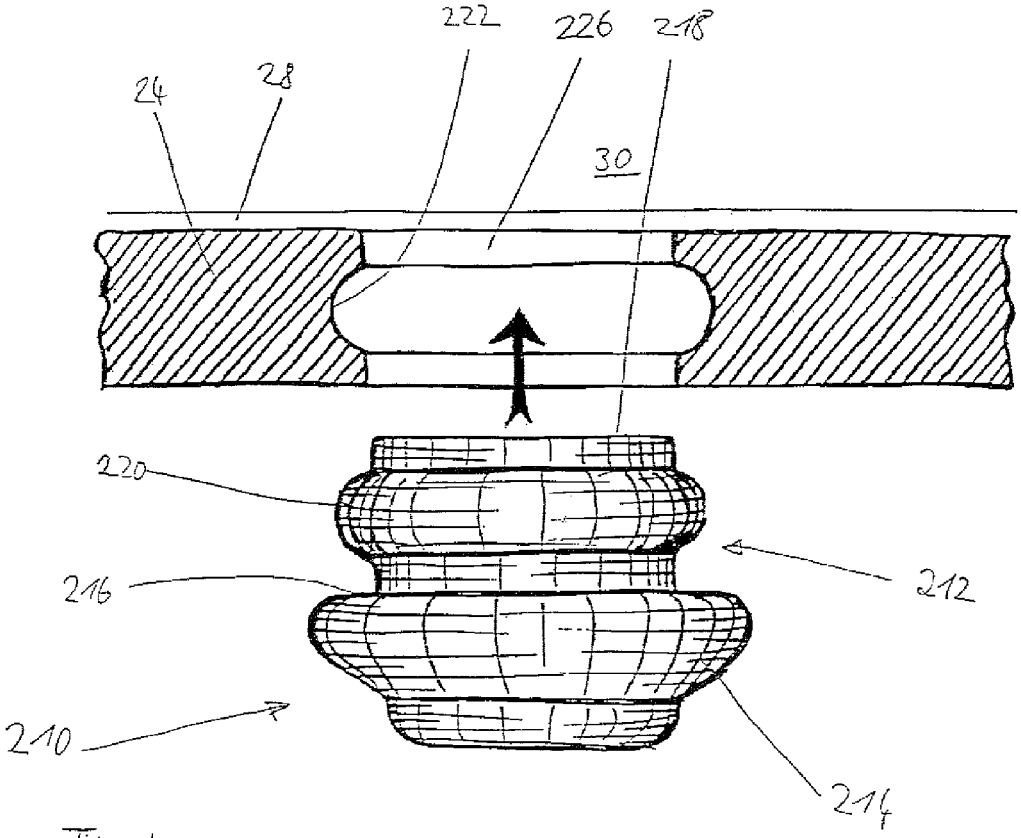
FIGS. 4*a* and 4*b* show partially sectional views of a third embodiment of a fixation element in conformity with the invention during and after, respectively, insertion into a bore of a wall of the external auditory canal of a user.
Figure 4B:
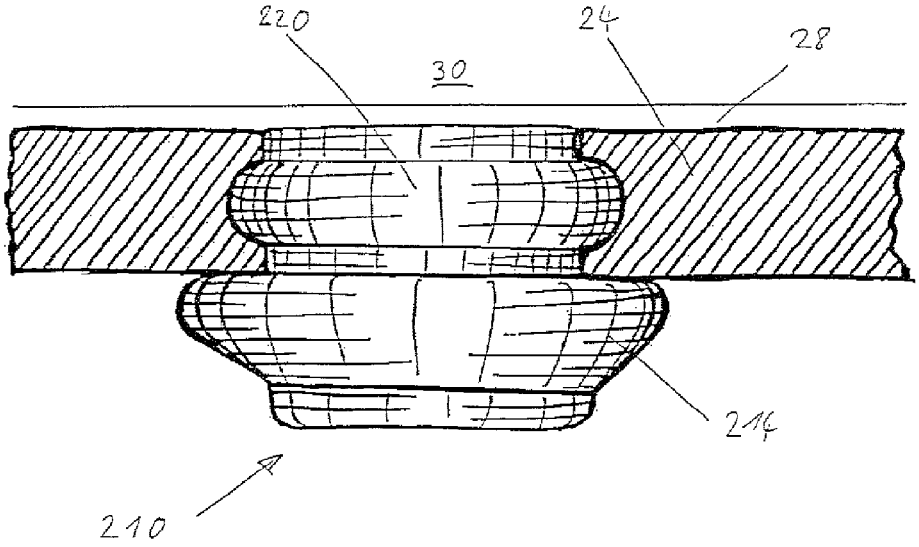

The fixation element 210 shown in FIGS. 4*a* and 4*b* differs from the embodiments described so far essentially in that a cylindrical portion or stud 212 thereof is provided with a circumferentially extending bulging 220 of elastic material which, in the inserted state of fixation element 210, engages a mating portion in the wall of a bore 226 receiving the fixation element 210. For this purpose, bore 226 in the auditory canal wall 24 is provided in a central zone thereof with a circumferentially extending recess 222 the contour of which is substantially complementary to the contour of bulging 220 on stud 212. However, the dimensions of recess 222 are slightly smaller than those of bulging 220, whereby, upon insertion of fixation element 210 into bore 226, elastic restoring forces become effective and provide for a secure mounting of fixation element 210.

Bulging 220 is disposed in essentially the center of stud 212, so that upon introduction of the fixation element 210 a free end 218 of stud 212 is substantially flush with the auditory canal wall 24 facing auditory canal skin 28.

Fixation element 210 includes a flange portion 214 similar to flange portion 114 of the embodiment of FIGS. 3*a* to 3*c*. Flange portion 214 has a contact surface 216 which engages the other side of auditory canal wall 24 and assists fixing of the fixation element 210 by preventing movement of the fixation element towards the auditory canal 30. Bulging 220, in view of its symmetrical structure, fixes fixation element 210 in both directions. However, in cases in which, as illustrated in FIGS. 4*a* and 4*b*, there is a flange portion 214 having contact surface 216, a symmetrical structure of bulging 220 and of recess 222 is not necessary. Rather it is sufficient when bulging 220 engages recess 222 in a manner merely preventing the fixation element from being pulled out of bore 226, e.g. by bulging 220 tapering at its side facing the free end 218 substantially slower than at its other side.

An introduction of fixation element 210 into bore 226 is made possible by the elasticity of bulging 220.

Figure 5A:
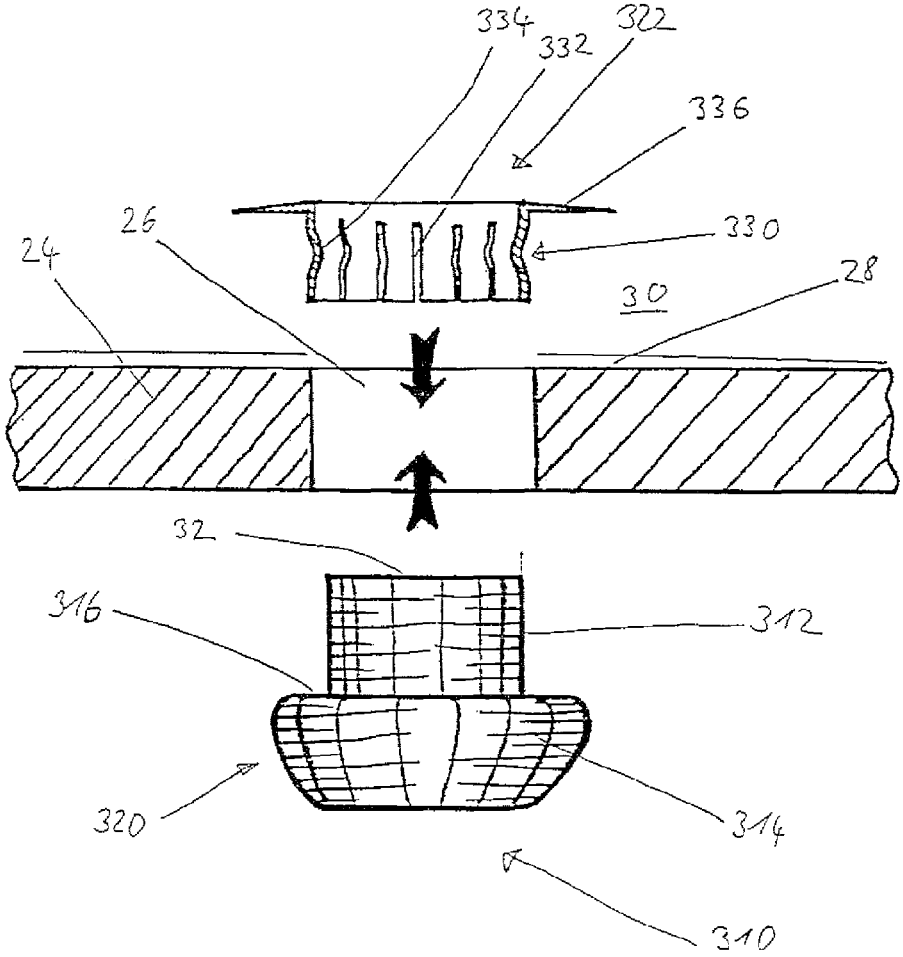
FIGS. 5*a* and 5*b* show views similar to FIGS. 4*a* and 4*b* for a fourth embodiment of a fixation element in conformity with the invention.
Figure 5B:
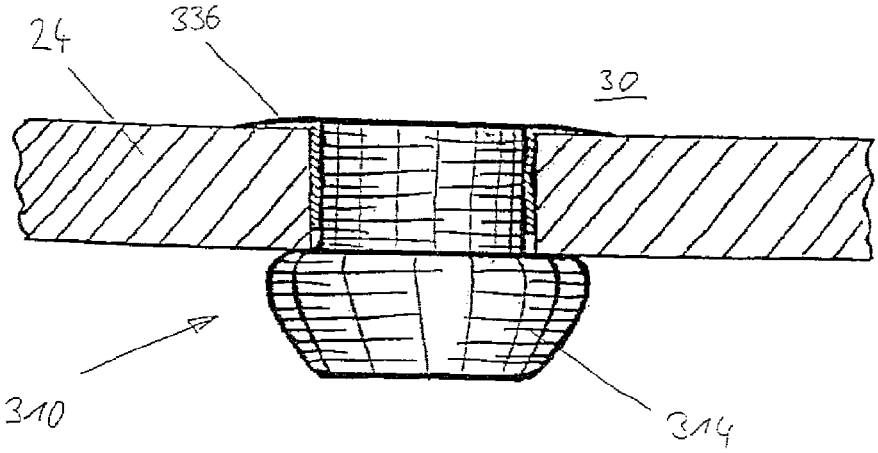

FIGS. 5*a* and 5*b* show a fixation element 310 which, different from the embodiments described above, consists of a pair of separate members, namely a main member 320 and a fixing member 322, which are fixedly engaged with each other when they are inserted into the bore 26 of the external auditory canal. Main member 320, in a manner similar to the above discussed embodiments, surrounds the sound sensor and includes a circular cylindrical portion 312 which is connected to a thickened flange portion 314 having a contact surface 316. The sound receiving membrane 32 is disposed at the free end of cylindrical portion 312. The fixing member 322 has a sleeve portion 330 which is connected to a circumferentially extending, radially projecting flange portion 336. Slots 332 which are circumferentially spaced from one another extend in axial direction in sleeve portion 330 from the free end thereof and sleeve portion 330 includes in its central region at the inner side thereof a circumferentially extending nose 334 which is defined by a dent in the wall of the sleeve portion 330. The inner diameter of sleeve portion 330 is selected so that sleeve portion 330 can be slid over the free end of the cylindrical portion 312 of main member 320, wherein, however, sleeve portion 330 is expanded from the side of its free end. Therefore elastic restoring forces are produced which provide for a save engagement of the sleeve portion 330, and particularly the nose 334 thereof, with the circumferential surface of the cylindrical portion 312, the latter being a substantially smooth surface.

The fixing member 322 may be made for example from a biocompatible metal, such as titanium, or from a plastic material suited to obtain the required elastic restoring forces.

Implantation of fixation element 310 is effected by disposing the fixing member 322 at the side of bore 26 facing the auditory canal 30 and disposing main member 320 at the opposite side of bore 26. Subsequently, both members 320, 322 are moved towards each other in axial direction and enter bore 26, wherein sleeve portion 330 slides over cylindrical portion 312 and provides for a safe engagement between members 320 and 322. Alternately, also at first main member 320 or fixing member 322 may be completely introduced into bore 26. In the implanted state illustrated in FIG. 5*b*, flange portion 336 of fixing member 322 contacts the side of auditory canal wall 24 facing auditory canal skin 28, whereas contact surface 316 of main member 320 abuts the opposite side of auditory canal wall 24 to thereby provide for securing fixation element 310 within bore 26.

Figure 6A:
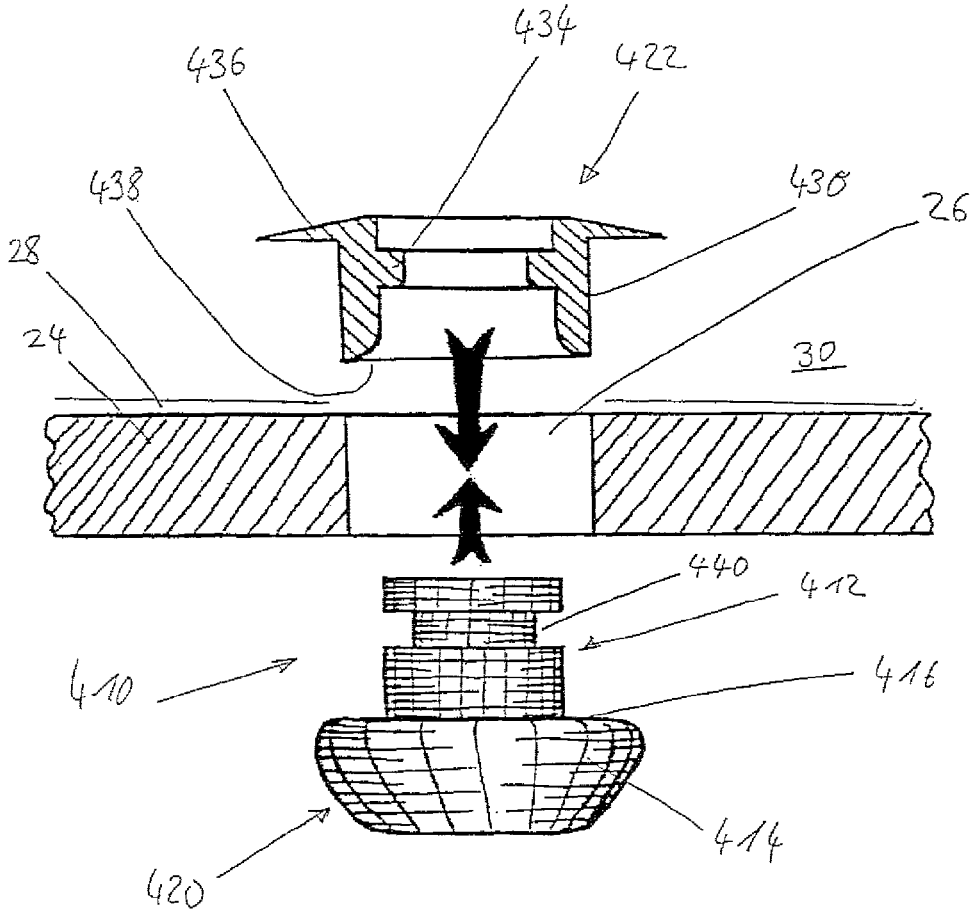
FIGS. 6*a* and 6*b* show views similar to FIGS. 5*a* and 5*b* for a fifth embodiment of a fixation element in conformity with the invention.
Figure 6B:
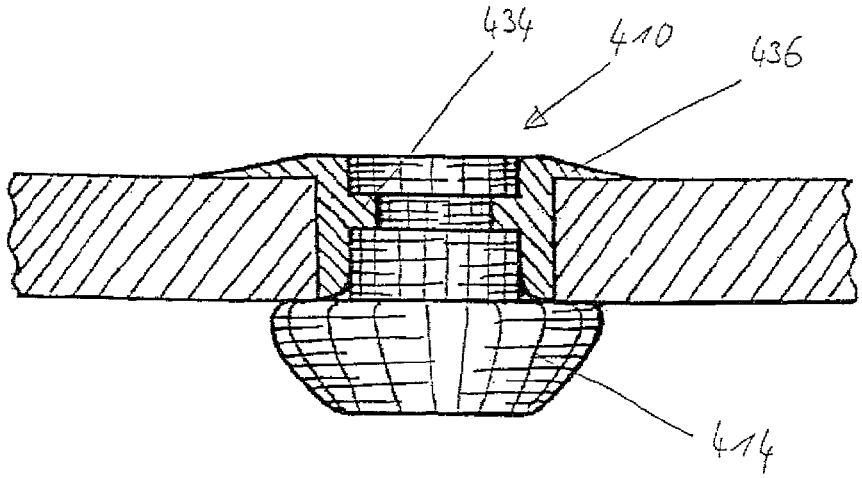

FIGS. 6*a* and 6*b* show an embodiment of a fixation element 410 which differs from the embodiment of FIGS. 5*a* and 5*b* essentially as to the type of providing for a secure engagement between a main member 420 and a fixing member 422 of fixation element 410 in axial direction. Whereas in the embodiment of FIGS. 5*a* and 5*b* the engagement is effected by a clamping mechanism, members 420 and 422 of the embodiment of FIGS. 6*a* and 6*b* are interengaged by being interlocked. For this purpose, a cylindrical portion or stud 412 of main member 420 is provided at the outer side thereof with a circumferentially extending recess or groove 440, whereas a sleeve portion 430 of fixing member 422 is provided at the inner side thereof with a circumferentially extending rip-like projection 434. The shapes of projection 434 and groove 440 are substantially complementary to each other. In the case of the embodiment shown, a rectangular contour is selected for projection 434 and groove 440. However, any other suitable geometry may be selected. For example the side of projection 334 which in FIGS. 6*a* and 6*b* is downwardly directed may be beveled in order to facilitate introduction of stud 412 into sleeve portion 430. Fixing member 422 further includes a flange 436. The end of sleeve portion 430 remote from flange 436 is beveled or curved at its inner side as indicated at 438. Thereby introduction of stud 412 is facilitated.

Implantation of fixation element 410 is effected in the same manner as implantation of fixation element 310 illustrated in FIGS. 5*a* and 5*b*. In the implanted state, as shown in FIG. 6*b*, projection 434 is locked in recess 440, and fixation element 410 is held in bore 26 by flange 436 and contact surface 416 of flange portion 414 of main member 420 contacting opposite sides of auditory canal wall 24.

Figure 7A:
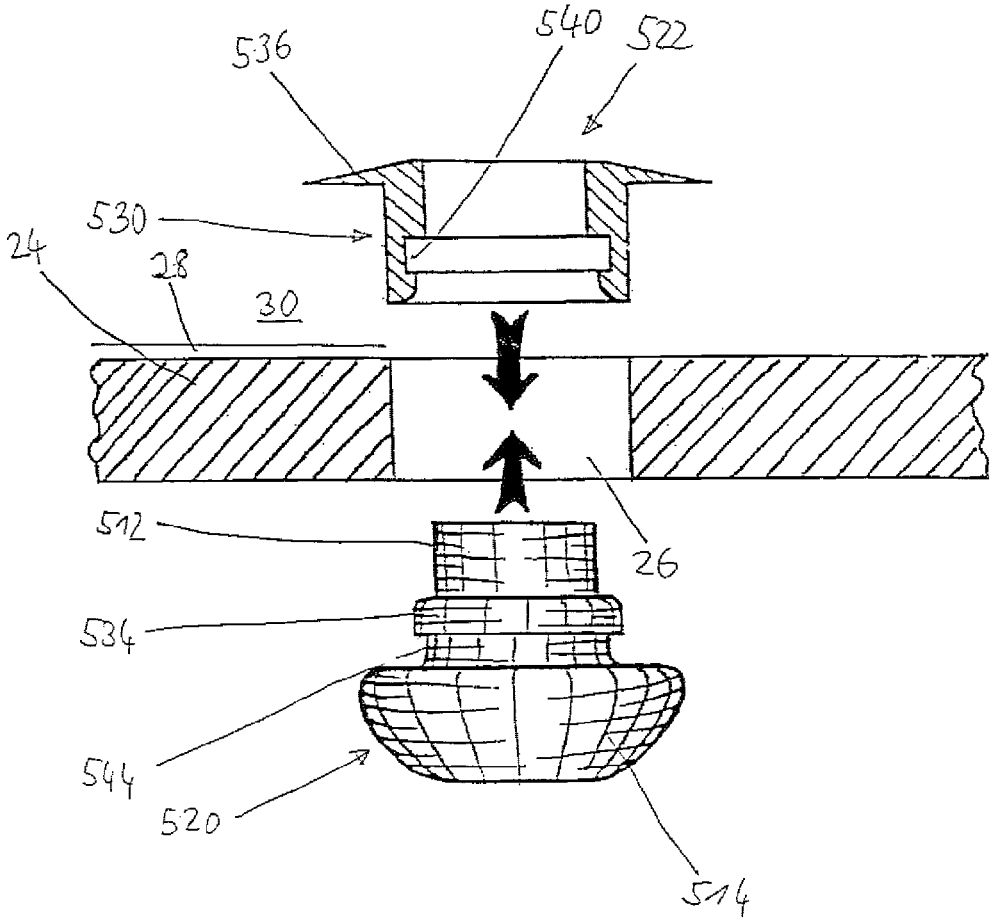
FIGS. 7*a* and 7*b* show views similar to FIGS. 5*a* and 5*b* for a sixth embodiment of a fixation element in conformity with the invention.
Figure 7B:
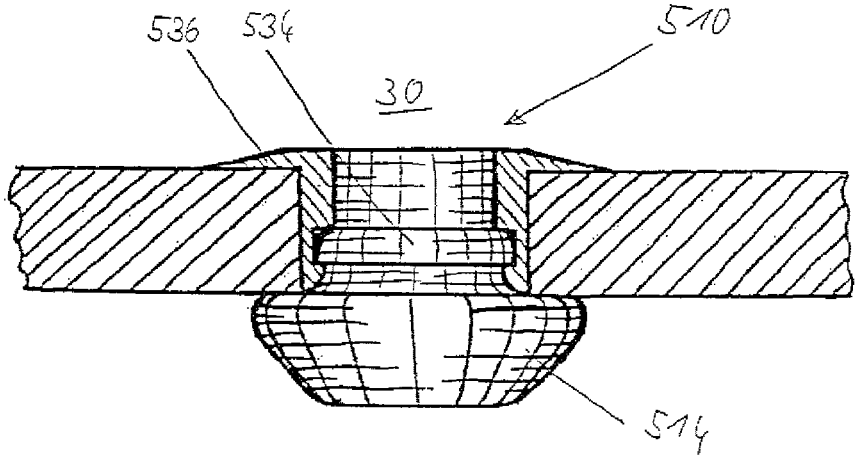

FIGS. 7*a* and 7*b* illustrate a fixation element 510 comprising a main member 520 and a fixing member 522. Main member 520 includes a stud 512 and a flange portion 514. Fixing member 522 is provided with a sleeve portion 530 and a flange portion 536. The embodiment of FIGS. 7*a* and 7*b* differs from the embodiment of FIGS. 6*a* and 6*b* essentially in that a circumferentially extending recess or groove 540 is provided at the inner side of sleeve portion 530, whereas a circumferentially extending rip-like projection 534 is disposed at the outer circumferential surface of stud 512. In order to facilitate introduction of stud 512 into sleeve portion 530, the circumferentially extending projection 534 is beveled or curved as indicated at 542 at its side facing the fixing member 522. Furthermore, main member 520 includes a transition region 544 between stud 512 and flange portion 514, wherein the diameter of transition region 544 progressively increases in the direction from projection 534 to flange portion 514. Different therefrom, the corresponding regions of the studs of the embodiments of FIGS. 5*a* and 5*b* as well as of FIGS. 6*a* and 6*b* have a constant diameter.

Implantation of fixation element 540 is effected in a manner analog to that described with reference to FIGS. 6*a* and 6*b*.

Figure 9A:
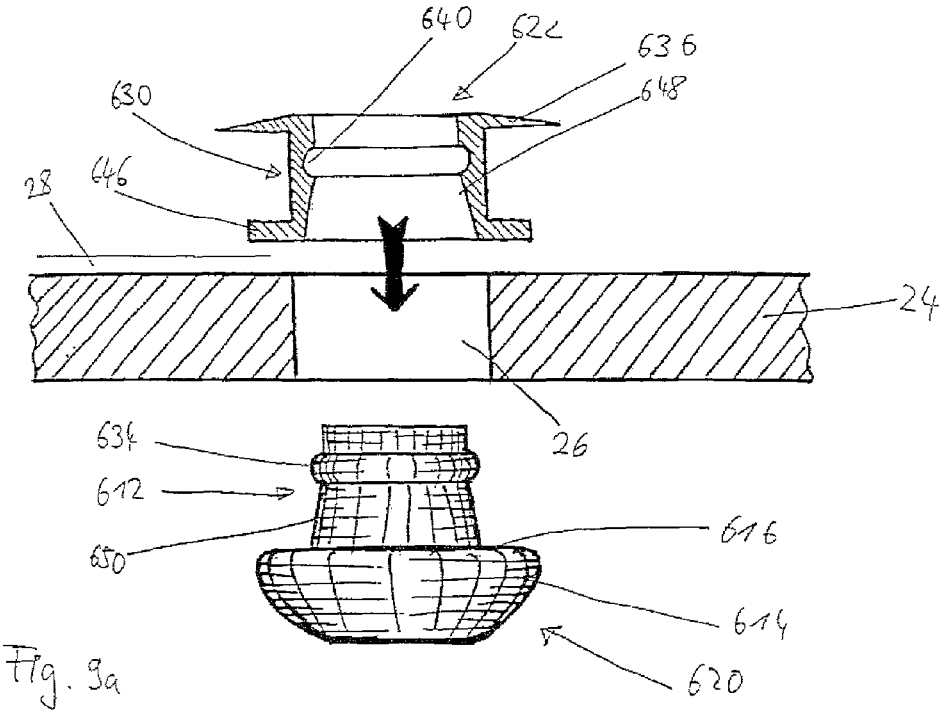
FIGS. 9*a*, 9*b* and 9*c* are partially sectional side views of a seventh embodiment of a fixation element in conformity with the invention showing three different phases of introduction of the fixation element into a bore of a wall of the external auditory canal of a user.
Figure 9B:
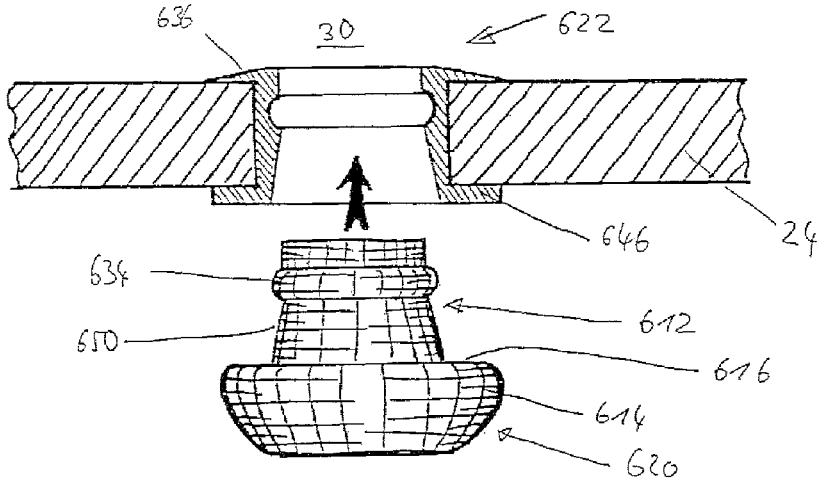
Figure 9C:
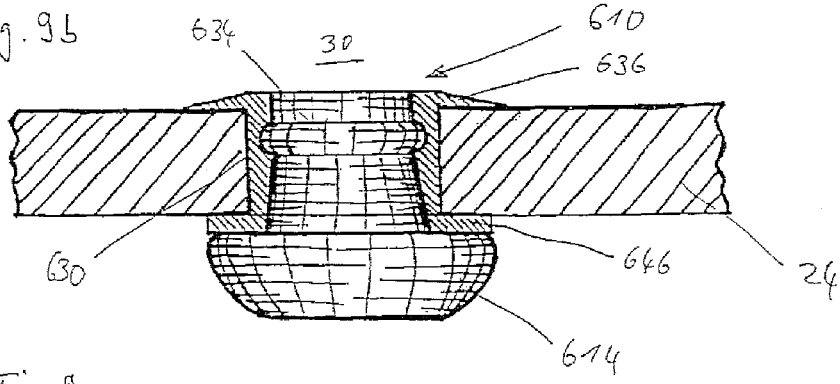

FIGS. 9*a* to 9*c* show a further embodiment of a two-part fixation element comprising a main member 620 and a fixing member 622. Main member 620 includes a stud 612 and a flange portion 614 having a contact surface 616. The embodiment of FIGS. 9*a* to 9*c* differs from the above described two-part embodiments essentially in that fixing member 622 is provided at both ends of a sleeve portion 630 with radially outwardly projecting flanges 636 and 646, respectively, which, in the implanted state, contact both sides of auditory canal wall 24. Thus, fixing member 622 as a whole is configured in the type of a collared sleeve or a grommet. Sleeve portion 630 is provided at the inner circumferential surface thereof with a circumferentially extending recess or groove 640 having a rounded profile. The inner circumferential surface of sleeve portion 630 is cylindrical, i.e. has a constant diameter, in the zone between groove 640 and flange 636 which, in the implanted state, contacts the side of auditory canal wall 24 facing auditory canal skin 28. Different therefrom, the region 648 of the inner circumferential surface of sleeve portion 630 between groove 640 and the second flange 646 which, in the implanted state, engages the opposite side of auditory canal wall 24, is of conical configuration with its diameter increasing towards flange 646. Fixing member 622 is made of elastic material, preferably silicone.

Stud 612 of main member 620 is provided at the outer circumference thereof with a rounded projection 634 which is complementary to groove 640. Stud 612 is provided near its free end with a cylindrical portion. It further includes a conical portion 650 disposed between projection 634 and flange portion 614, wherein the diameter of conical portion 650 increases towards flange portion 614.

In the course of implantation at first fixing member 622 is introduced into bore 26 from the side of the auditory canal, as indicated in FIGS. 9*a* and 9*b*. Before introduction, fixing member 622 is radially compressed whereby flange 646 can be introduced into and passed through bore 26. Thereafter, as illustrated in FIG. 9*b*, flange 646 contacts the side of auditory canal wall 24 remote from auditory canal skin 28. It is also possible to introduce fixing member 622 into bore 26 not from the side of the auditory canal, but rather from the side of auditory canal wall 24 remote from the auditory canal. Subsequently, main member 620 is pushed, starting with the free end of stud 612, into fixing member 622 from the side of auditory canal wall 24 remote from auditory canal skin 28, until projection 634 snaps into groove 640 whereby main member 620 is fixed relative to fixing member 622. In the final position illustrated in FIG. 9*c*, contact surface 616 of flange portion 614 contacts flange 646 of fixing member 622. The free end of stud 612 is substantially flush with flange 636. The conical configuration of portion 650 provides for a certain compression of fixing member 622 within bore 26 resulting in an improved sealing effect and better fixation of fixing member 622 within bore 26.

Figure 10A:
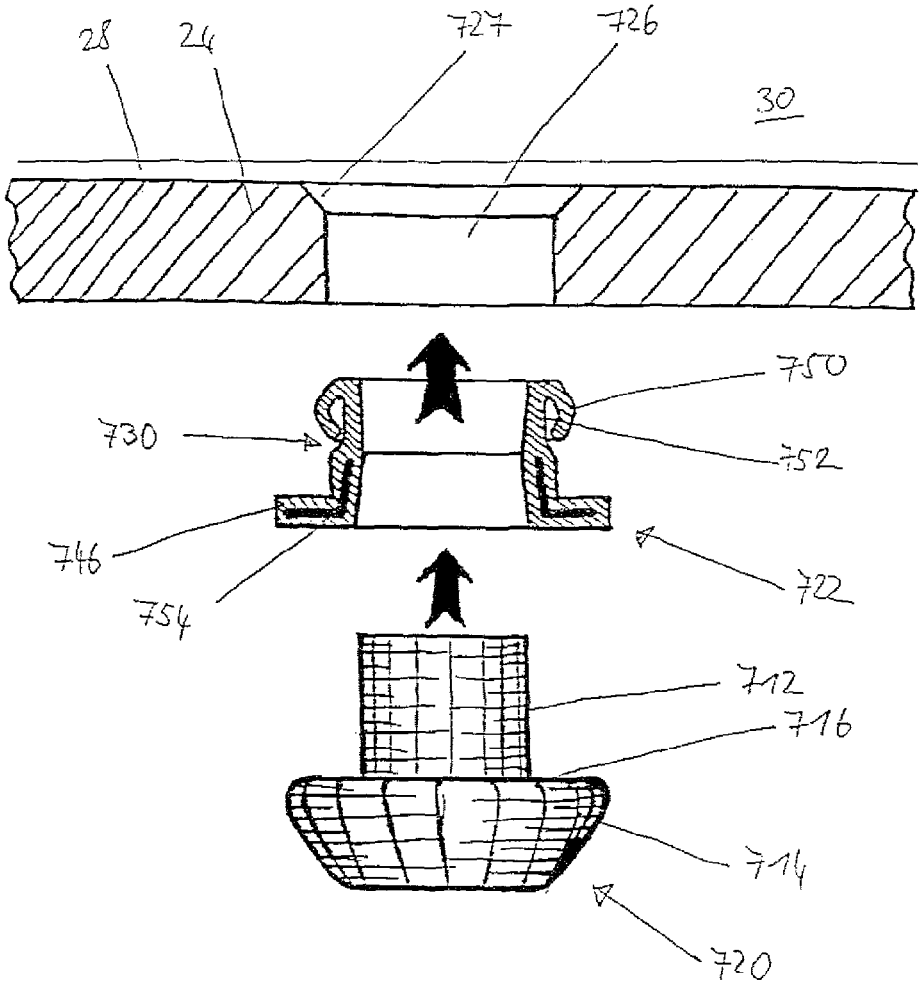
FIGS. 10*a* and 10*b* show views similar to FIGS. 5*a* and 5*b* for an eighth embodiment of a fixation element in conformity with the invention.
Figure 10B:
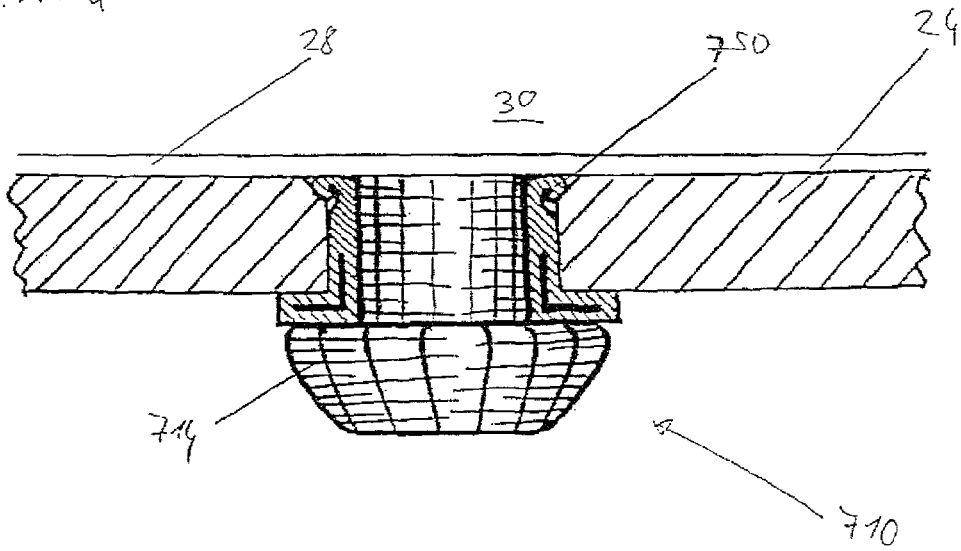

In the embodiment illustrated in FIGS. 10*a* and 10*b* a fixation element 710 likewise comprises a main member 720 and a fixing member 722. However, fixing member 722 is provided with a flange 746 at one end only of a sleeve portion 730, whereas a circumferentially extending elastic lip element 750 is disposed at the other end of sleeve portion 730. A bore 726 in auditory canal wall 24 is provided at the side facing the auditory canal skin 28 with a chamfer 727 whereas the remainder of bore 726 is circular cylindrical. Lip element 750 is intended to engage, in the implanted state, chamfer 727, whereas flange 746 is designed to engage the side of auditory canal wall 24 remote from auditory canal skin 28. In the non-implanted state lip element 750 extends rearwardly with respect to the direction of introduction or the free end of sleeve portion 730, respectively, with lip element 750 at first projecting radially outwardly and subsequently radially inwardly. The outer diameter of sleeve portion 730 is decreased in a zone 752 adjacent to lip element 750 in order to facilitate folding back of lip element 750 during introduction into bore 726. Fixing member 722 is introduced into bore 726 from the side of auditory canal wall 24 remote from auditory canal skin 28, wherein lip element is leading, until finally lip element 750 engages chamfer 727. When lip element 750 reaches chamfer 727, elastic restoring forces become active. These forces are sufficiently high to prevent fixing member 722 from moving rearwardly in the direction of the side of auditory canal wall 24 remote from auditory canal skin 28.

In this position, flange 746 abuts the side of auditory canal wall 24 remote from auditory canal skin 28 and thus prevents fixing member 27 from moving further towards the auditory canal 30.

The inner circumferential surface of sleeve portion 730 is designed such that the inner diameter of sleeve portion increases towards both ends thereof wherein, as illustrated in FIG. 10*a*, these two zones are conical and meet each other in a central zone of sleeve portion 730 so that within this central zone the internal diameter has a minimum. Furthermore, a circumferentially extending elastic angle member 754 is provided as a reinforcement in the region of flange 746. Angle member 754 extends both within sleeve portion 730 and flange 746 and defines an angle slightly larger than 90.degree. Angle member 754 may be made for example from metal or from a sufficiently rigid plastic material.

Main member 720 includes a circular cylindrical stud 712 which is connected to a flange portion 714 having a contact surface 716. Stud 712 is pushed from the side of auditory canal wall 24 remote from auditory canal 30 into fixing member 722 which is positioned in bore 726, until the free end of stud 712 is flush with the side of auditory canal wall 24 facing auditory canal skin 28, and until contact surface 716 contacts flange 746. The double-conical configuration of the inner surface of sleeve portion 730 such that the minimum inner diameter within the central zone is smaller than the outer diameter of stud 712, in combination with angle member 754 which is compressed by pushing in of stud 712, provides for elastic restoring forces and for mutual clamping of stud 712 and sleeve portion 730. Thereby main member 720 is prevented from sliding rearwardly, and main member 720 is securely held within fixing member 722 and thus within bore 726.

Figure 11A:
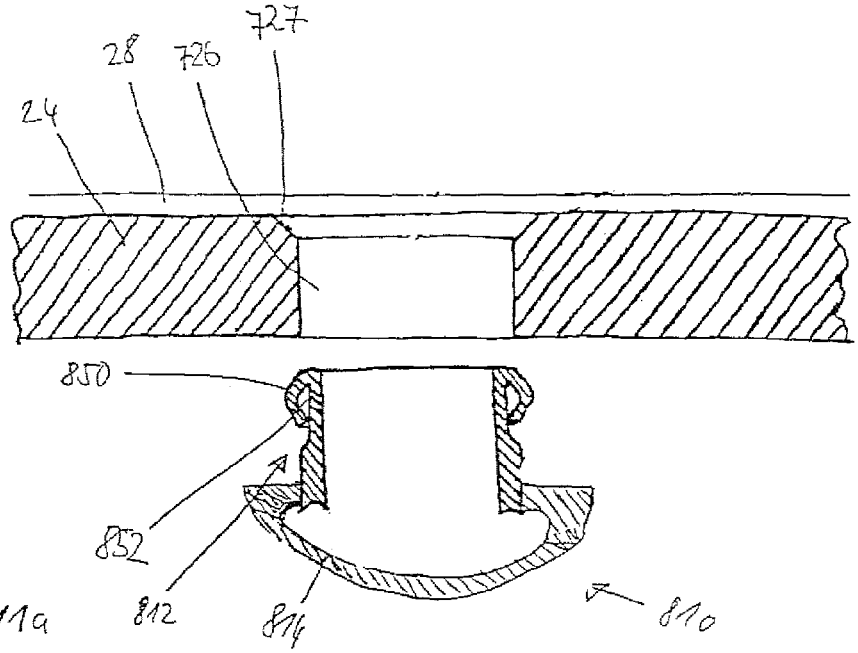
FIGS. 11*a*, 11*b* and 11*c* are views similar to FIGS. 9*a*, 9*b* and 9*c* for a ninth embodiment of a fixation element in conformity with the invention.
Figure 11B:
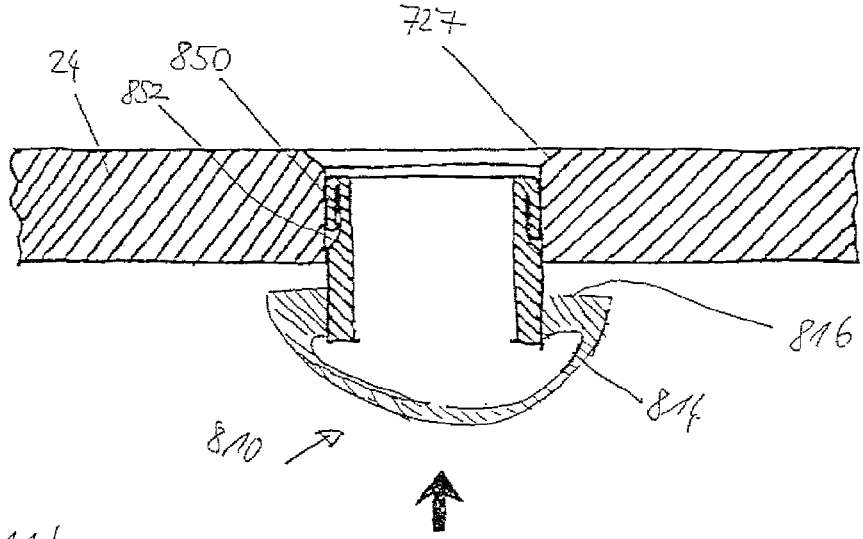
Figure 11C:
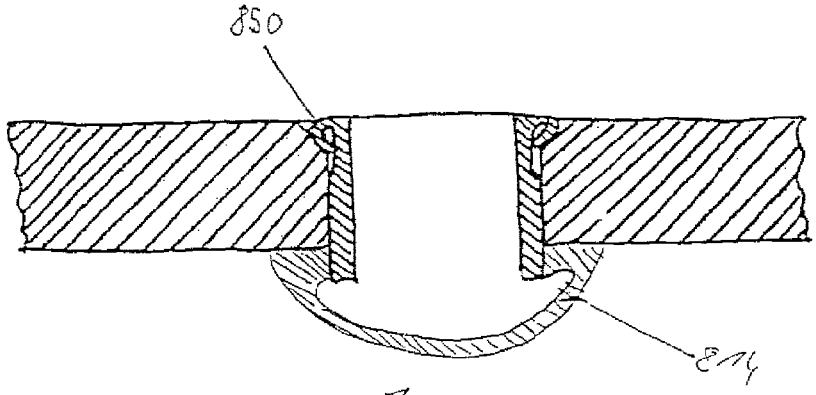

A modification of the basic principle used in the embodiment of FIGS. 10*a* and 10*b* is shown in FIGS. 11*a* to 11*c*. This embodiment is configured as a single-part fixation element 810 rather than a two-part fixation element. In the embodiment of FIGS. 11*a* to 11*c* fixation element 810 comprises a stud 812 and a flange portion 814 connected thereto. A circumferentially extending lip element 850 is disposed at a free end of stud 812. Stud 812 is introduced into bore 726 from the side of auditory canal wall 24 remote from auditory canal skin 28. Bore 726 is provided, at the side thereof facing auditory canal skin 28, with chamfer 727.

FIG. 11*b* illustrates the condition of lip element 850 during passage through the cylindrical section of bore 726. As illustrated, lip element 850 is folded rearwardly with respect to the direction of introduction, and is disposed, in a substantially flat condition, in a reduced outer diameter zone 852 of stud 812, whereby introduction of stud 812 is facilitated. When the final position shown in FIG. 11*c* is reached, lip element 850 engages chamfer 727, wherein lip element 850 again bulges outwardly as permitted by the increased diameter of bore 726 in the region of chamfer 727. In the condition illustrated in FIG. 11*c*, a contact surface 816 of flange portion 814 engages the side of auditory canal wall 24 remote from auditory canal skin 28 whereby further movement of stud 812 into auditory canal 30 is prevented. Accordingly, the position illustrated in FIG. 11*c* is maintained, in which the free end of stud 812 is substantially flush with the side of auditory canal wall 24 facing auditory canal skin 28. On the other hand, engagement of lip element 850 with chamfer 727 prevents stud 812 from sliding rearwardly in the direction of the side of auditory canal wall 24 remote from auditory canal skin 28. In this manner proper fixing of fixation element 810 within bore 726 is attained.

FIGS. 12*a*, 12*b*, 13*a* and 13*b* show, as a further single-part embodiment, a fixation element 910 having a stud 912 and a flange portion 914. Stud 912 essentially is of circular cylindrical shape. A group of lamellas is provided at a free end 918 of stud 912. Lamellas 920 are uniformly distributed along the circumference of stud 912 and have one end 922 thereof connected to stud 912 in a manner permitting lamellas 920 to be pivotally moved around end 922 thereof Lamellas 920 are held by a wire loop 924 which extends around stud 912. Optionally, the interconnection between lamellas 920 and stud 912 may be configured so as to bias by suitable biasing means, e.g. springs (not shown), lamellas 920 from the position shown in FIG. 12*a* toward a position illustrated in FIG. 12*b*. That means, the biasing force acts to fold lamellas 920 rearwardly with respect to the free end of stud 912. Lamellas 920 preferably are made of metal.

Figure 12A:
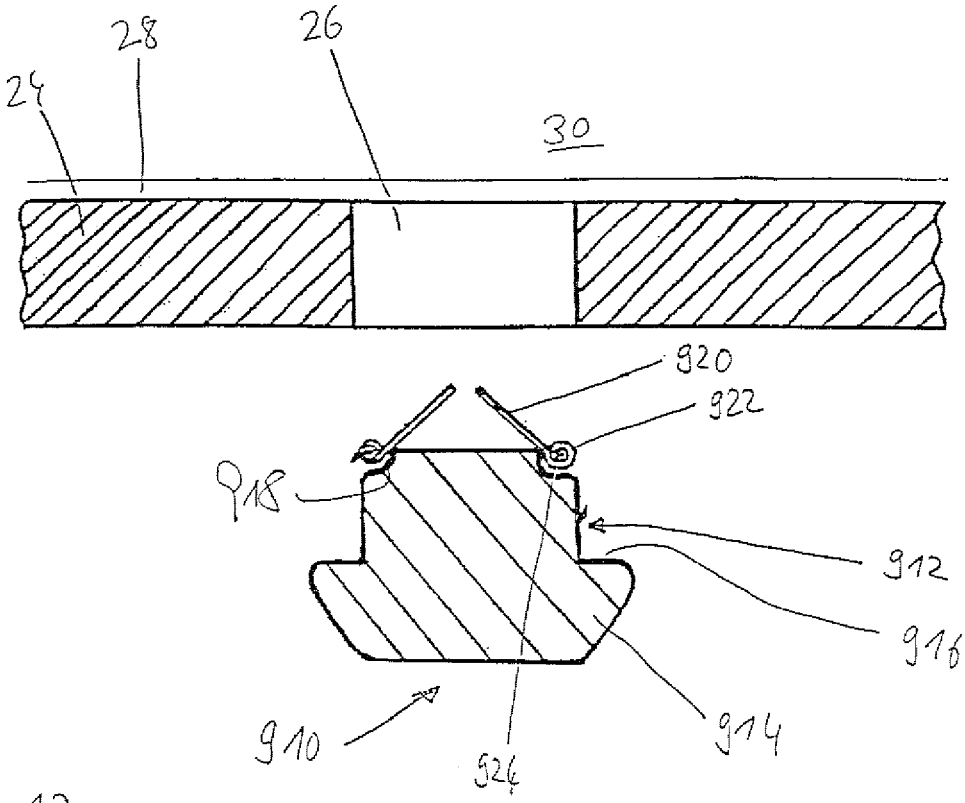
FIGS. 12*a* and 12*b* are sectional views for a tenth embodiment of a fixation element in conformity with the invention before and after, respectively, insertion into a bore of a wall of the external auditory canal of a user.
Figure 12B:
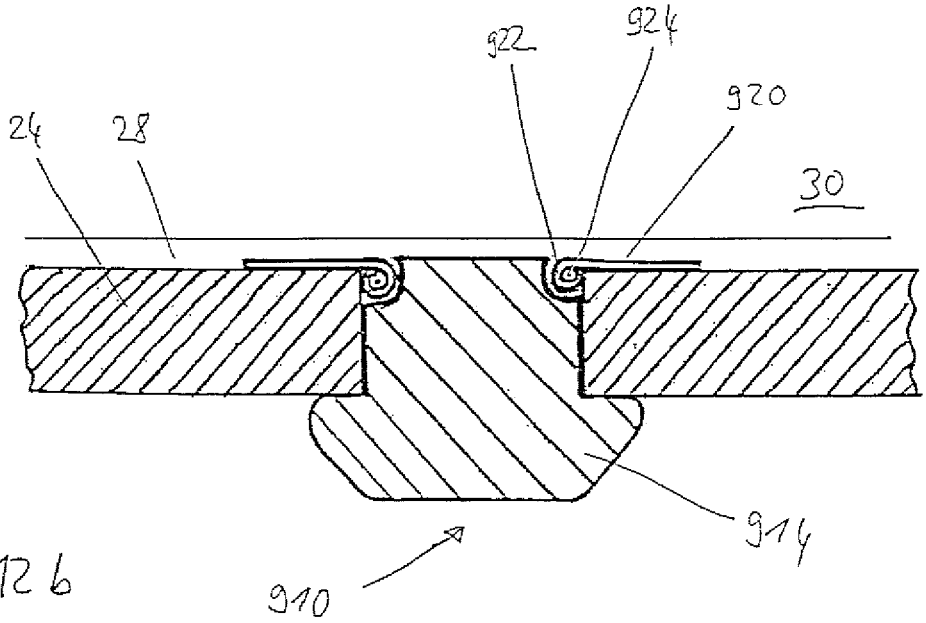
Figure 13A:
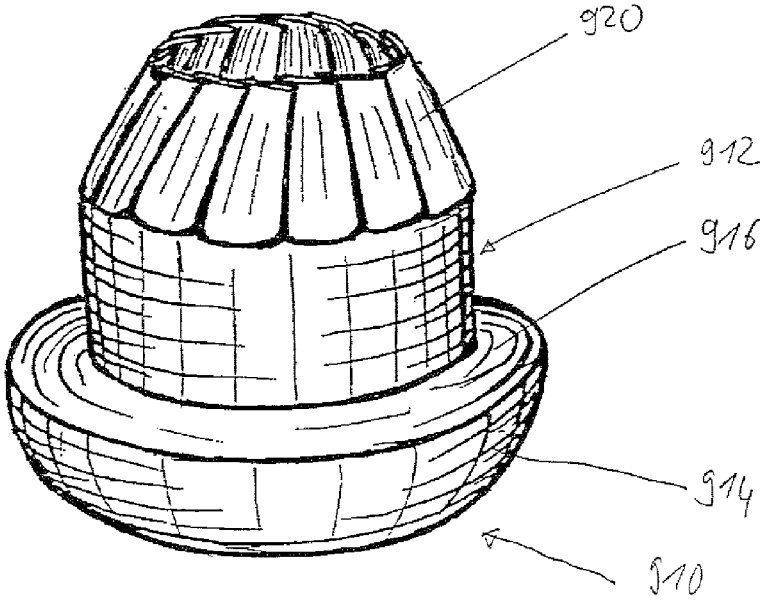
FIGS. 13*a* and 13*b* are perspective views corresponding to FIGS. 12*a* and 12*b*, respectively.
Figure 13B:
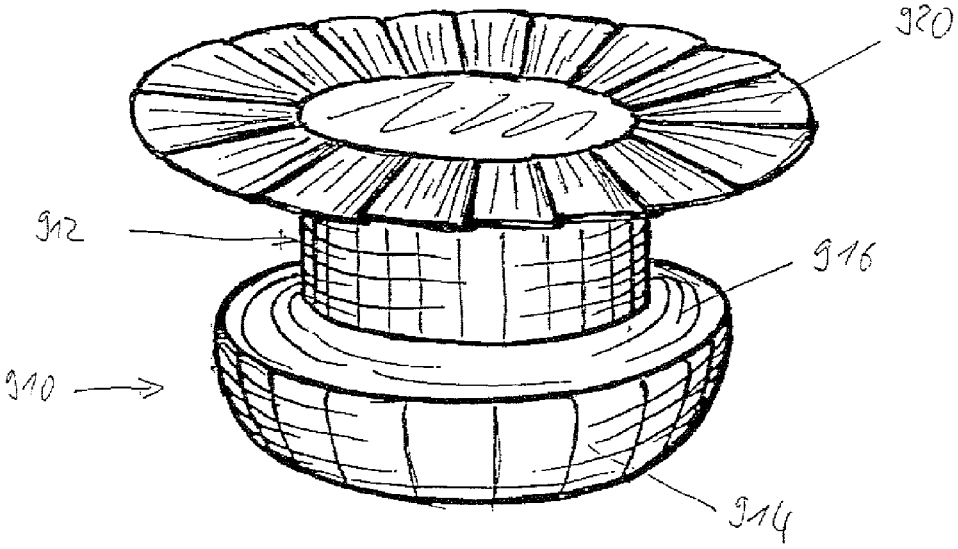

Before introduction into bore 26, lamellas 920 are folded forwardly with respect to the free end of stud 912 into the position shown in FIGS. 12*a* and 13*a*, and are held in this position. In this condition, the free ends of lamellas 920 are directed radially inwardly. In this position, fixation element 910 is introduced into bore 26 from the side of auditory canal wall 24 remote from auditory canal skin 28, with the lamellas 920 leading, until free end 918 of stud 912 is approximately flush with the side of auditory canal wall 24 facing auditory canal skin 28, as illustrated in FIG. 12*b*. In this position, a contact surface 916 of flange portion 914 connected to stud 912 abuts the side of auditory canal wall 24 remote from auditory canal skin 28, whereby stud 912 is prevented from moving further towards auditory canal 30. In this position, lamellas 920 are folded rearwardly around wire loop 924, optionally assisted by a biasing force, and finally contact the side of auditory canal wall 24 facing auditory canal skin 28. This position in which lamellas 920 define a sheet-like compound is illustrated in FIGS. 12*b* and 13*b*. The auditory canal skin 28 disposed above lamellas 920, optionally assisted by a biasing force acting on lamellas 920, prevents lamellas 920 from folding upwardly. In this manner, fixation element 910 is prevented from sliding out of bore 26 in the direction of the side of auditory canal wall 24 remote from auditory canal skin 28. Thus, fixation element 910 is safely supported within bore 26. Preferably, lamellas 920 are configured such that in the position in which they contact the auditory canal wall 24 they overlap each other in the manner of tiles, to thus provide for a sealing of bore 26.

Figure 14:
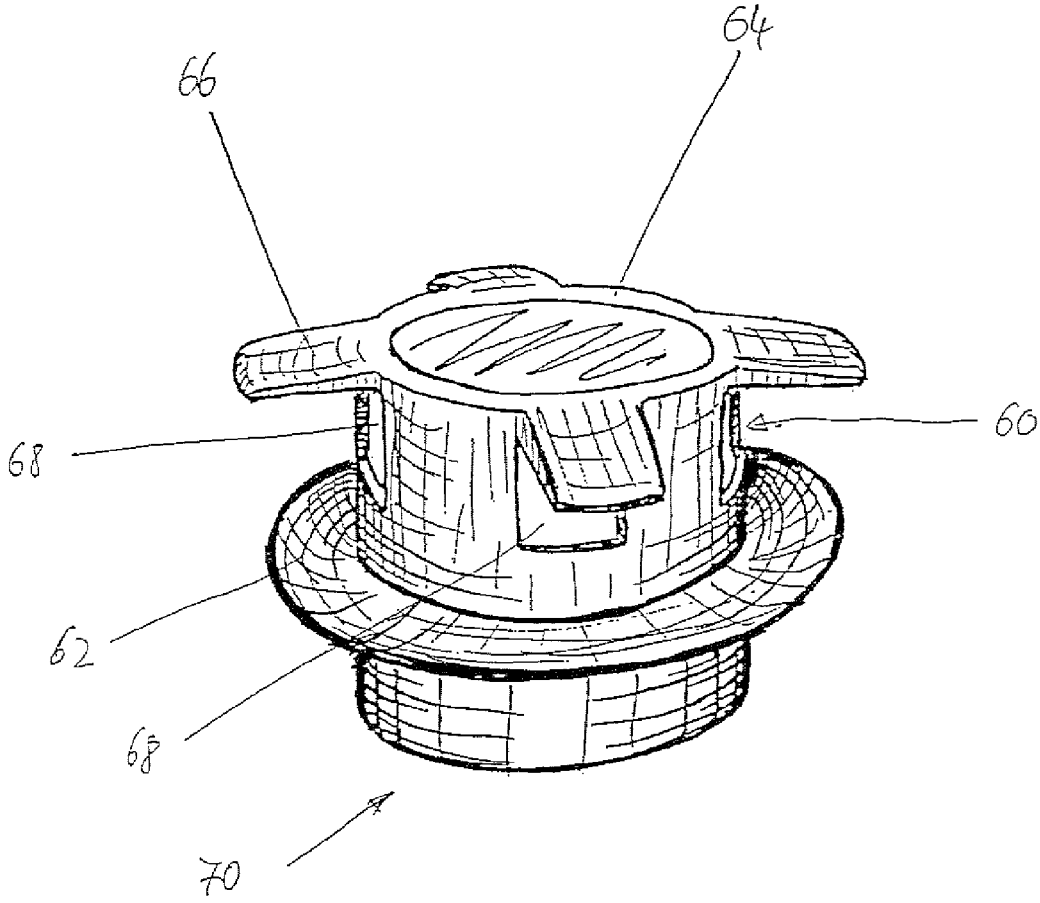
FIG. 14 is a perspective view of an eleventh embodiment of a fixation element in conformity with the invention.
Figure 15:
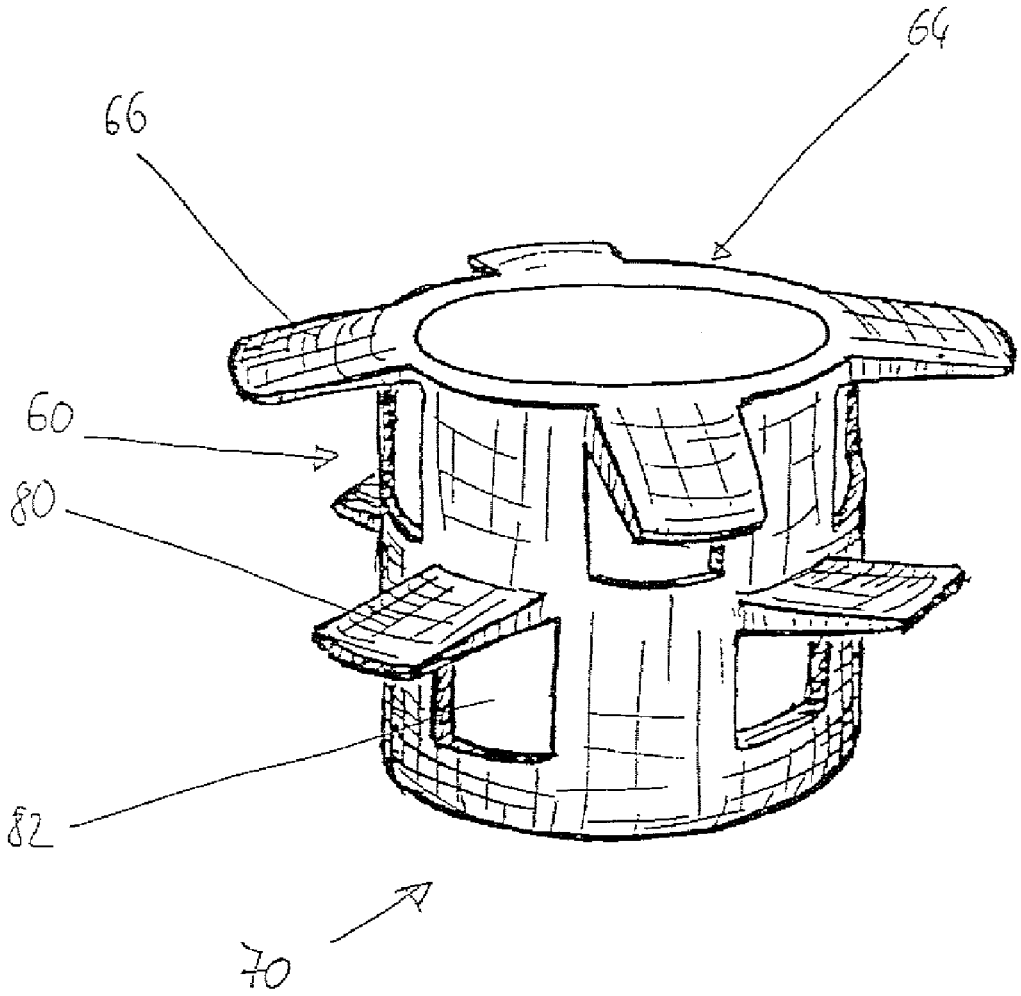
FIG. 15 is a view similar to FIG. 14 for an alternative, embodiment of a fixation element in conformity with the invention.

FIGS. 14 and 15 illustrate two further embodiments in which one or both flanges are replaced by a plurality of holding tongues which are distributed in circumferential direction.

FIG. 14 shows an element 70 having a circular cylindrical section 60 provided with a circumferentially extending flange portion 62. Flange portion 62 is configured as an elastic rim which preferably is made of silicone and which is disposed at a central part of cylindrical portion 60. A flange portion consisting of four holding tongues 66 is provided at a free end 64 of cylindrical portion 60. The holding tongues 66 project radially outwardly at an angle of about 90.degree. and are equally spaced around the circumference of cylindrical portion 60. A recess 68 is disposed in the wall of cylindrical portion 60 adjacent to each holding tongue 66. Recesses 68 are dimensioned in conformity with the dimensions of holding tongues 66 and permit the holding tongues to be folded rearwardly (as seen from the free end 64) into the associated recesses in order to facilitate introduction of the cylindrical portion 60 into a corresponding bore of the wall of the external auditory canal. For this purpose, holding tongues 66 are elastic. Upon having passed the bore, holding tongues 66, under the influence of elastic restoring forces, revert into the position illustrated in FIG. 14 to fix the cylindrical portion 60 in the bore by contacting the respective wall of the auditory canal. In order to allow such a folding back of holding tongues 66, free end 64 of cylindrical portion 60 must be pushed into the external auditory canal by a certain amount beyond the respective end of bore 26. In doing so, flange portion or rim 62 is moved by a certain amount into bore 26 upon having been rearwardly folded due to its elasticity. After holding tongues 66 have returned to the position illustrated in FIG. 14, cylindrical portion 60 is retracted in bore 26 until the bottom side of holding tongues 66 abuts the respective wall of the auditory canal. Rim 62 now contacts the opposite side of the wall of the auditory canal to securely fix cylindrical portion 60 within the bore.

Element 70 illustrated in FIG. 14 preferably is a hollow cylinder receiving a main member similar to the above described two-part embodiments, which main member encloses the sound sensor and is clamped or locked within element 70 in the described manner. Alternatively, element 70 may constitute a single-part fixation element within which the casing of the sound sensor is fixed, for example glued, before introduction into bore 26.

The embodiment illustrated in FIG. 15 differs from the embodiment of FIG. 14 essentially in that rim 62 is replaced by a second group of holding tongues 80 which are configured in a manner analog to the group of holding tongues 66, which, however, are displaced relative to the latter by about 45.degree. in circumferential direction. Recesses 82 are associated to holding tongues 80. Recesses 82 are adapted to receive holding tongues 80 when free end 64 of cylindrical portion 60 is pushed by a certain amount into the auditory canal to allow folding out of the holding tongues 66.

The terms "flange" and "flange portion" are intended to design a member which radially outwardly projects at an angle of about 90 degrees from a cylindrical portion and which is provided with an essentially plane contact surface at at least one side thereof. The member may encircle the cylindrical portion, i.e. may have a substantially constant outer radius, or the outer radius can vary in circumferential direction to provide for example for an undulated outer contour. The flange member even may be interrupted, i.e. for example may consist of individual tongues distributed in circumferential direction.

The term "circumferentially extending" used for example in connection with "circumferentially extending portion" is not intended to exclude interruptions, e.g. slots and the like, provided within the respective portion.

The term "stud" is intended to designate a portion which may be essentially cylindrical, particularly circular cylindrical, or may be tapered, i.e. particularly may comprise one or more conical sections.

Basically, also combinations of the described embodiments are possible. For example locking or clamping mechanisms described for some of the embodiments of two-part fixation elements, likewise may be used for all other embodiments comprising a two-part fixation element. Furthermore, features of embodiments of a single-part fixation element may be used in the case of two-part fixation elements, such as projections, sealing lips and the like extending along the outer circumference to fixingly and/or sealingly engage a bore wall, instead of or in addition to flange portions contacting the auditory canal wall. Furthermore, all described single-part embodiments may be modified to constitute two-part embodiments by designing the stud or cylindrical portion of the described single-part embodiments as a separate sleeve member into which a stud of a main member enclosing the sensor may be introduced and locked or clamped prior to or during implantation.

In the case of single-part embodiments of the fixation element, i.e. in embodiments in which the fixation element comprises a stud which at least partly directly contacts the wall of the bore, requiring a certain amount of elasticity, a biocompatible plastic material having a Shore A-hardness from 20 to 70 is particularly suited. The plastic material especially may be selected from the group of silicones and polyurethanes.

In the case of the two-part embodiments, this selection of materials also applies to the member of the fixation element which comprises the sleeve portion and which contacts the wall of the bore. In these two-part embodiments the member which comprises the stud (and the sensor) to be introduced into the sleeve portion may have a lower elasticity than in the case of the single-part embodiments. Particularly materials such as biocompatible metals, e.g. titanium or harder plastic materials, likewise may be used at least for the stud.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

What is claimed is:

1. A fixation element for an implantable microphone, said fixation element comprising first and second members, wherein said first member has a stud adapted for insertion into a bore which crosses a wall of the auditory canal of a user, wherein said stud has a first free end and an opposite second end and encloses a housing part of the microphone at the outer circumference thereof, which housing part is provided with a sound receiving member, and wherein said second member comprises a first flange portion and a sleeve portion, said sleeve portion having opposite first and second ends and being adapted to be slipped, starting with the first end thereof, over said first end of said stud and to be engaged with the stud for preventing at least relative axial movement between the stud and the sleeve portion, and said first flange portion being provided at the second end of the sleeve portion, the first flange portion radially outwardly projecting at an angle of about 90 degrees from a cylindrical surface of the sleeve portion, and being provided with an essentially planar contact surface at least a side thereof that is adapted to engage, in the implanted state of the fixation element, the side of the wall of the auditory canal facing the skin of the auditory canal.

2. The fixation element as claimed in claim 1, wherein a flange portion is provided at the second end of the stud, said flange portion being adapted to contact, in the implanted state of the fixation element, the side of the wall of the auditory canal remote from the skin of the auditory canal.

3. The fixation element as claimed in claim 1, wherein the sleeve portion is elastic in radial direction and is adapted to be expanded by introduction of the stud into the sleeve portion, and wherein elastic restoring forces of the expanded sleeve portion provide for said engagement between the sleeve portion and the stud.

4. The fixation element as claimed in claim 3, wherein the sleeve portion is provided with circumferentially spaced slots which start from said first end and which extend in axial direction.

5. The fixation element as claimed in claim 3, wherein the sleeve portion is provided in a central region thereof with a nose which extends in circumferential direction on the inner side of the sleeve portion and which, in the implanted state of the fixation element, contacts the outer circumference of the stud to provide for said engagement between the sleeve portion and the stud.

6. The fixation element as claimed in claim 1, comprising locking means for providing said engagement between the sleeve portion and the stud.

7. The fixation element as claimed in claim 6, wherein the sleeve portion is provided at the inner side thereof with a circumferentially extending recess, and wherein the stud is provided at the outer circumference thereof with a circumferentially extending bulging which, in the implanted state of the fixation element, extends into said recess.

8. The fixation element as claimed in claim 6, wherein the stud is provided at the outer circumference thereof with a circumferentially extending recess, and wherein the sleeve portion is provided at the inner side thereof with a circumferentially extending bulging which, in the implanted state of the fixation element, extends into said recess.

9. The fixation element as claimed in claim 6, wherein the inner diameter of the sleeve portion increases toward said one end thereof.

10. The fixation element as claimed in claim 1, wherein a second flange portion is provided at said first end of said sleeve portion, said second flange portion being adapted to contact, in the implanted state of the fixation element, the side of the wall of the auditory canal remote from the skin of the auditory canal.

11. The fixation element as claimed in claim 10, wherein the first flange portion is comprised of a plurality of circumferentially spaced holding tongues.

12. The fixation element as claimed in claim 10, wherein the second flange portion is comprised of a plurality of circumferentially spaced holding tongues.

13. The fixation element as claimed in claim 10, wherein the stud comprises a conical section the diameter of which increases toward the second end of the stud.

* * * * *